United States Patent [19]

Hanson

[11] Patent Number: 4,888,669

[45] Date of Patent: Dec. 19, 1989

[54] EXTERIOR LIGHTING SYSTEM

[75] Inventor: Mark L. Hanson, Long Lake, Minn.

[73] Assignee: MinnFac, Inc., Minneapolis, Minn.

[21] Appl. No.: 254,211

[22] Filed: Oct. 6, 1988

[51] Int. Cl.[4] ..... F21V 21/00

[52] U.S. Cl. ..... 362/145; 362/367; 362/371; 362/432

[58] Field of Search ..... 362/145, 146, 147, 152, 362/153, 432, 812, 362, 367, 368, 370, 371; 298/221.3, 222.1, 224.3, 224.4

[56] References Cited

U.S. PATENT DOCUMENTS

| | | | |
|---|---|---|---|
| 852,759 | 5/1907 | Bergener | 248/222.1 |
| 1,403,725 | 1/1922 | Williams | 362/371 |
| 2,239,343 | 4/1941 | Rumbaugh | 362/812 |
| 2,273,668 | 2/1942 | Steiner | 248/224.4 |
| 2,721,255 | 10/1955 | Lanmon | 362/146 |
| 3,222,509 | 12/1965 | Thedford | 362/152 |
| 3,885,144 | 5/1975 | Lewis et al. | 362/146 |
| 4,104,712 | 8/1978 | Haefner | 362/218 |
| 4,317,164 | 2/1982 | Karaktin | 362/432 |
| 4,425,601 | 1/1984 | Donahue | 362/146 |
| 4,463,962 | 8/1984 | Snyder | 280/164 |
| 4,464,707 | 8/1984 | Forrest | 362/371 |
| 4,469,695 | 9/1984 | Chou | 248/224.4 |
| 4,491,902 | 1/1985 | Cangelosi | 362/389 |
| 4,549,712 | 10/1985 | Simon et al. | 248/224.4 |
| 4,620,636 | 11/1986 | Herr et al. | 248/224.4 |
| 4,625,266 | 11/1986 | Winter | 362/145 |
| 4,626,969 | 12/1986 | Kristofer | 362/371 |
| 4,689,726 | 8/1987 | Kretzschmar | 362/127 |
| 4,747,025 | 5/1988 | Barton | 362/370 |
| 4,748,548 | 5/1988 | Barton | 362/370 |
| 4,814,961 | 3/1989 | O'Brien et al. | 362/319 |

*Primary Examiner*—Stephen F. Husar
*Assistant Examiner*—Richard R. Cole
*Attorney, Agent, or Firm*—Kinney & Lange

[57] ABSTRACT

A light fixture includes a base on which rests a translucent housing having a pair of end pieces for securing the housing to the base. A pair of mirror image brackets, received by the base, are provided to secure the light fixture to a supporting surface. The brackets are positioned on the surface in a spaced-apart relationship for mating with a backplane of the light fixture. The backplane along with the elements of the light fixture supported thereon, have two rotational orientations supported for mounting on the mirror image brackets. The two rotational orientations provide distinct positional orientations of the light fixture with respect to its supporting surface.

9 Claims, 5 Drawing Sheets

EXTERIOR LIGHTING SYSTEM

BACKGROUND OF THE INVENTION

1. Field of the Invention.

The present invention relates to light fixtures in general, and, in particular, it relates to a light system for out of doors use.

2. Description of the Prior Art.

Exterior light fixtures are customarily used for both decorative and safety purposes. In the prior art, exterior light fixtures have generally been post-mounted lamps and wall-mounted lamps, the lamps in each being similar. An example is found in U.S. Pat. No. 4,104,712 to Hafner. The lamp of this patent includes a pyramidal four-sided hollow frame having a number of light-transmitting panes located in the interior of the frame. The lamp of this patent is mounted by unspecified means on a support.

U.S. Pat. No. 4,317,614 to Karaktin describes a method for mounting a lamp holder to a support such as a wall. Karaktin uses a pair of wedge-locking mounting brackets, one secured on the supports, the other on the support arm of the lamp holder, to mount an exterior light fixture. The support arm and the posts are brought into abutting relation with the abutting end of the hollow support arm receiving the mounting brackets secured to the posts.

Another mounting system is described in U.S. Pat. No. 4,491,902 to Carigelosi. This patent describes a mounting bracket having a bottom wall and a pair of oppositely positioned side-clamping walls. The side-clamping walls secure the bracket to a support. The bottom wall of the bracket receives the light fixture.

SUMMARY OF THE INVENTION

The present invention includes a light fixture having a backplane. The backplane includes first and second spaced-apart mounting slots. Mirror image mounting brackets are used to secure the light fixture to a support surface. Each of the mounting brackets has an elongated arm and an attachment portion at a substantially right angle to the elongated arm. The light fixture further includes means for securing the elongated arms within the first and second mounting slots of the backplane such that the brackets are interchangeably attachable within either mounting slot. This allows two rotational orientations of the light fixture for mounting on the mirror image brackets.

DETAILED DESCRIPTION OF THE PREFERRED EMBODIMENTS

Figure 1:
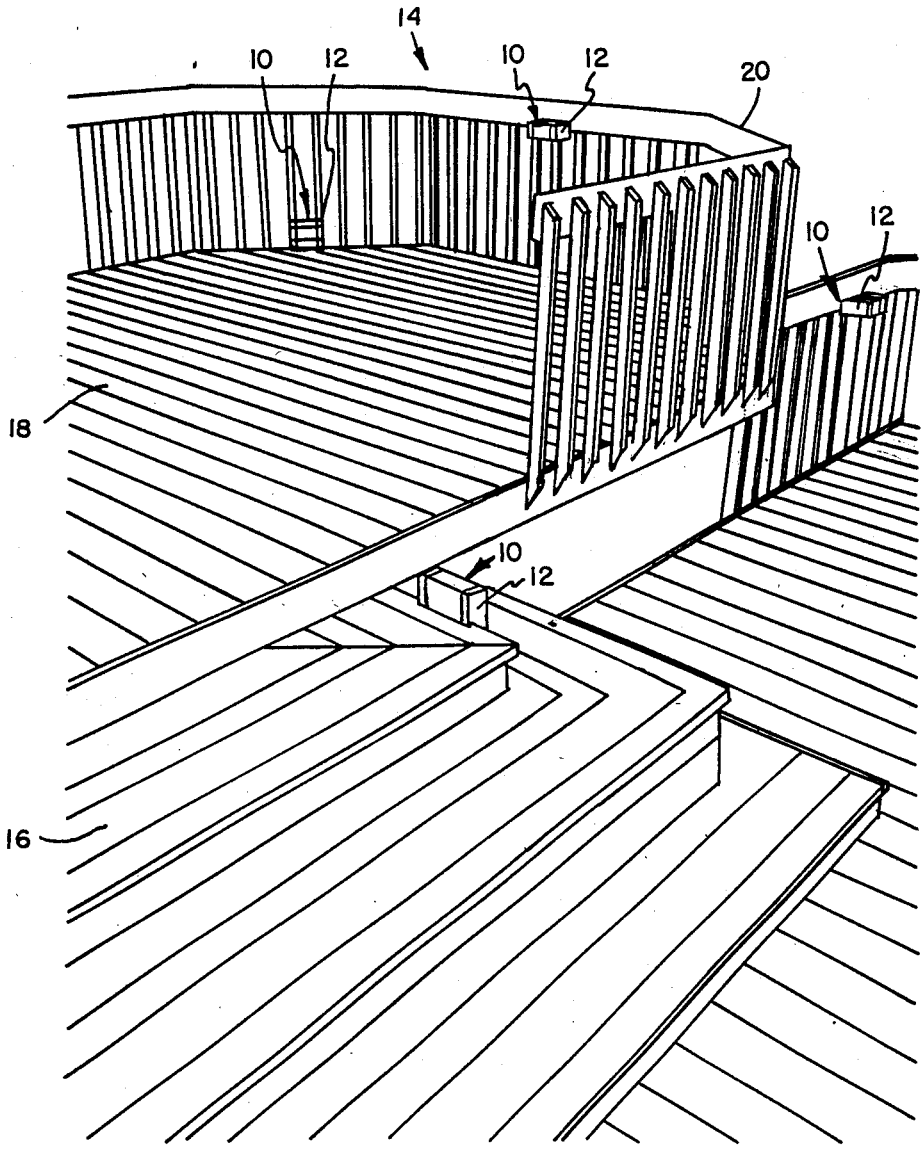
FIG. 1 is an perspective view of an outdoor porch with installed light fixtures of the present invention.

FIG. 1 illustrates an outdoor deck 14 with a lighting system provided by light fixtures 10. Light fixtures 10 are positioned on outdoor deck 14 adjacent stairways 16, floors 18 and on hand rails 20.

The geometry of the component parts of light fixture 10 allows the light fixture to be secured to deck 14 adjacent edges between intersecting surfaces, for example, a step and a riser of a stairway, overlapping a portion of both surfaces. Alternatively, light fixture 10 can be secured to the surface of a railing or overhanging member of the deck, without reference to the presence of an intersecting surface, to create the appearance of a suspended fixture.

Figure 2:
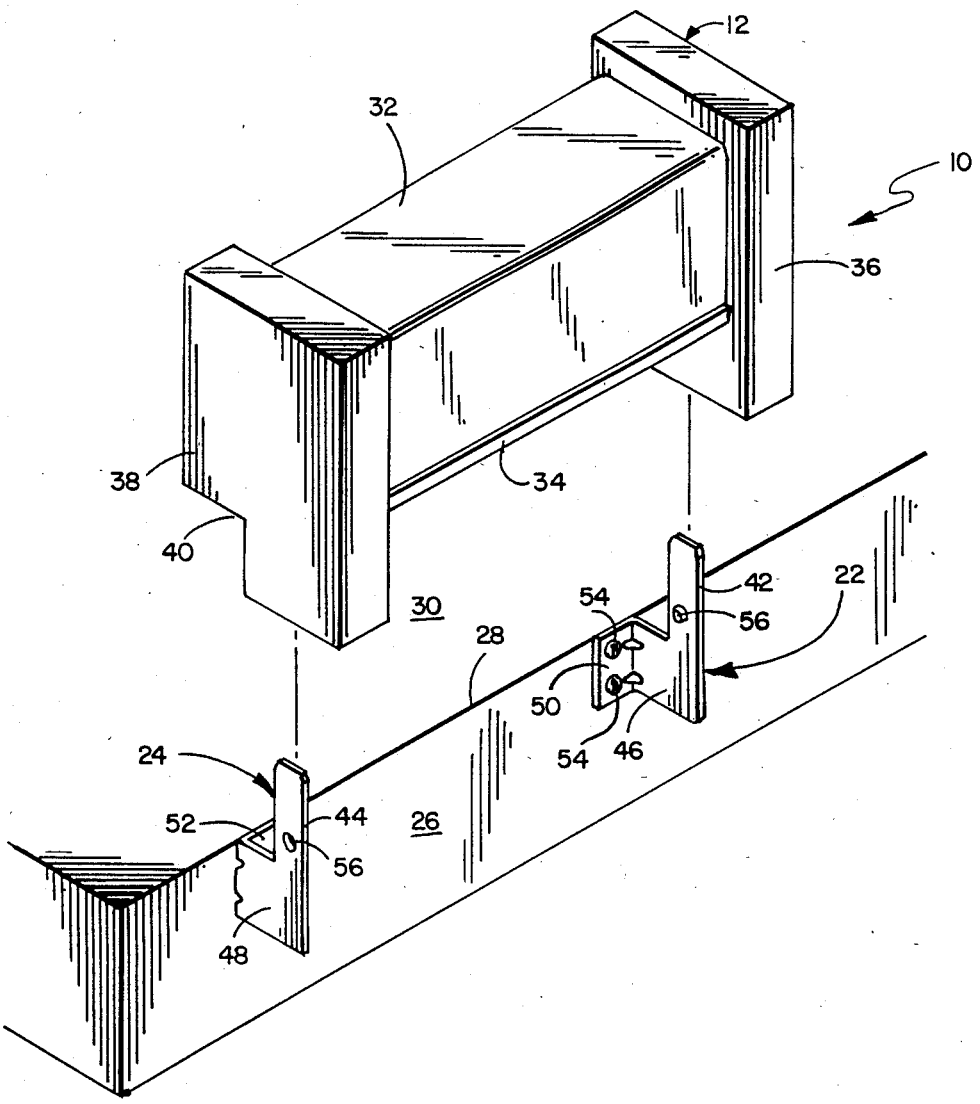
FIG. 2 is a perspective view of the light fixture of the present invention exemplifying a first rotational orientation.

As illustrated in FIG. 2, light fixture 10 comprises an elongated housing 12 in a first orientation for mounting on mirror image mounting brackets 22 and 24. Mirror image mounting brackets 22 and 24 are secured to a first surface 26 spaced and oriented at an appropriate distance with respect to one another. First surface 26 may be a riser or floor support, substantially adjacent and parallel to an edge 28 between the first surface and a second surface 30, such as a step or floor. First surface 26 and second surface 30 are typically flat and substantially perpendicular to one another. In the first orientation, mounted backplane 34 is held in a spaced, parallel relationship with second surface 30, extending through the plane of first surface 34 on secured mirror image mounting brackets 22 and 24.

Elongated housing 12 of light fixture 10 includes a U-shaped translucent body 32 supported in channels 35 on a backplane 34 between opaque end pieces 36 and 38. Backplane 34 supports a light source (shown in FIG. 7 below). End pieces 36 and 38 include indented right angle corners 40 allowing the indented corners to be brought flush with perpendicular surfaces 26 and 28 around edge 28 when housing 12 is mounted on mirror image mounting brackets 22 and 24 in the first orientation.

Mirror image mounting brackets 22 and 24 include elongated mounting arms 42 and 44, respectively. Elongated mounting arms 42 and 44 fit either of a pair of receiving slots provided in backplane 34 as described below. Elongated mounting arms 42 and 44 are held spaced from surface 26 by body portions 46 and 48, respectively. Extending perpendicularly from body portions 46 and 48 are attachment plates 50 and 52, respectively, which are attached to surface 26 by appropriate fasteners 54. Elongated mounting arms 42 and 44 include detent bores 56. When attached to a surface for supporting housing 12, mirror image brackets 22 and 24 are spaced from one another with elongated mounting arms 42 and 44 disposed in parallel and pointing in the same direction. Attachment plates 50 and 52 extend toward one another.

In the first orientation, mounting arm 42 is introduced to a slot adjacent end piece 36 and mounting arm 44 is introduced to a slot adjacent end piece 38. Backplane 34 breaks the plane of surface 34.

Figure 3:
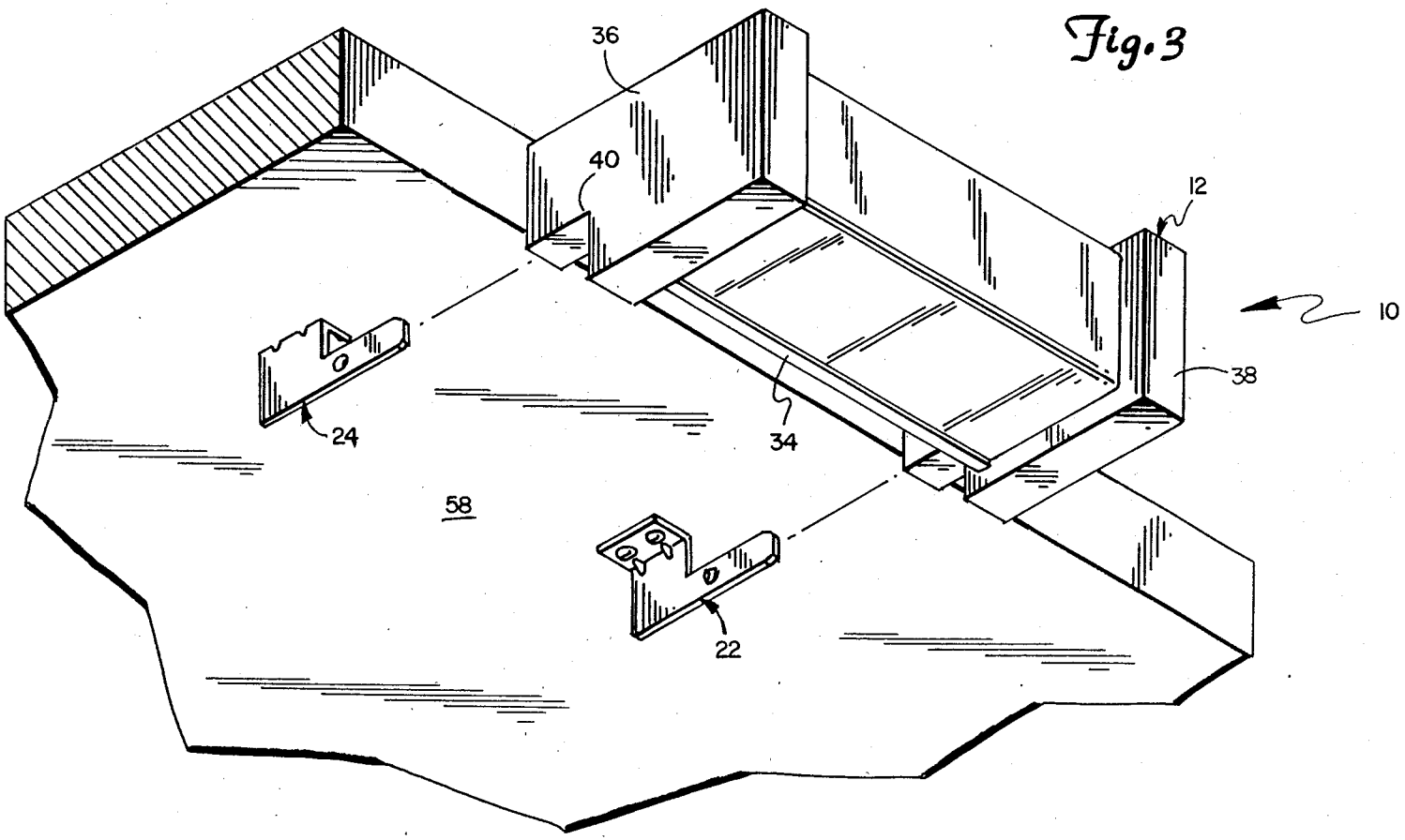
FIG. 3 is a perspective view of a light fixture of the present invention in an alternative rotational orientation.

FIG. 3 illustrates a second orientation of housing 12 of light fixture 10 for mounting on mirror image brackets 22 and 24. Mirror image mounting brackets 22 and 24 are attached to a surface 58, such as a ceiling, in the same spaced and oriented position as in FIG. 1, save that the brackets no longer need be proximate to an edge such as edge 28 (shown in FIG. 2). Housing 12 is oriented to place indented corners 40 away from surface 58, unlike the first orientation where the indented corners are adjacent the supporting surface. In the second orientation of housing 12, end piece 36 is adjacent mounting bracket 24, whereas in the first orientation it is adjacent to mounting bracket 22. The receiving slots in backplane 34 are removed toward one edge of the backplane so that housing 12 does not break the plane of the supporting surface when mounted in the second orientation. Endpieces 36 and 38 are flush with surface 58.

Figure 4:
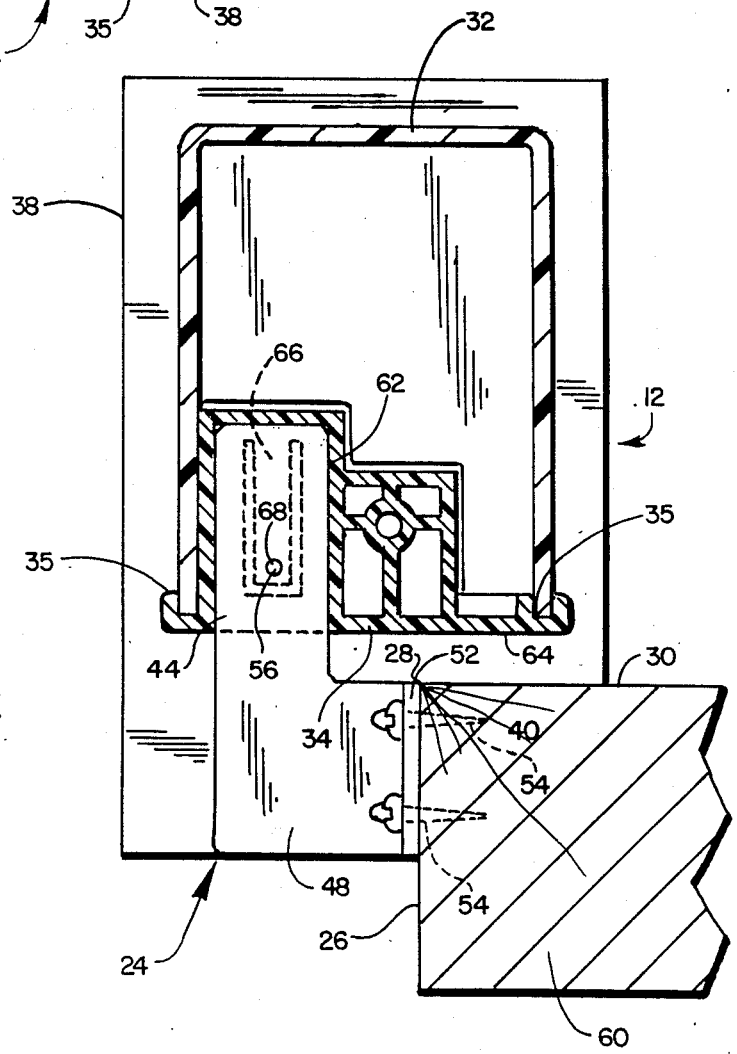
FIG. 4 is a sectional view illustrating the attachment of a bracket with the housing in the first rotational orientation.

FIG. 4 illustrates attachment of housing 12 to mounting bracket 24 in the first orientation of the housing. Mounting bracket 24 is positioned on surface 26 by fasteners 54 which have been screwed into wooden plank 60 through attachment plate 52 and surface 26. Body portion 48 extends vertically outward from surface 26 spacing elongated arm 44 from the surface. Elongated mounting arm 44 is supported by body portion 48 and extends parallel to the plane of the surface 26 through the plane of surface 30.

Backplane 34 of elongated housing 12 includes a slot 62 opening to rear face 64 of the backplane for receiving either of elongated members 22 or 24. Slot 62 is located substantially adjacent and parallel to end piece 38. In the first orientation of housing 12, elongated arm 44 is mated with slot 62. Torsion member 66 is positioned in a side wall of slot 62 and aligns with elongated arm 44 for urging a detent surface 68 (shown more clearly in FIG. 6) into bore 56. Detent surface 68 cooperates with bore 56 for fixing housing 12 on bracket 24. Bracket 22 cooperates in similar fashion with a second slot (shown in FIG. 6) located adjacent and parallel to end piece 36.

Figure 5:
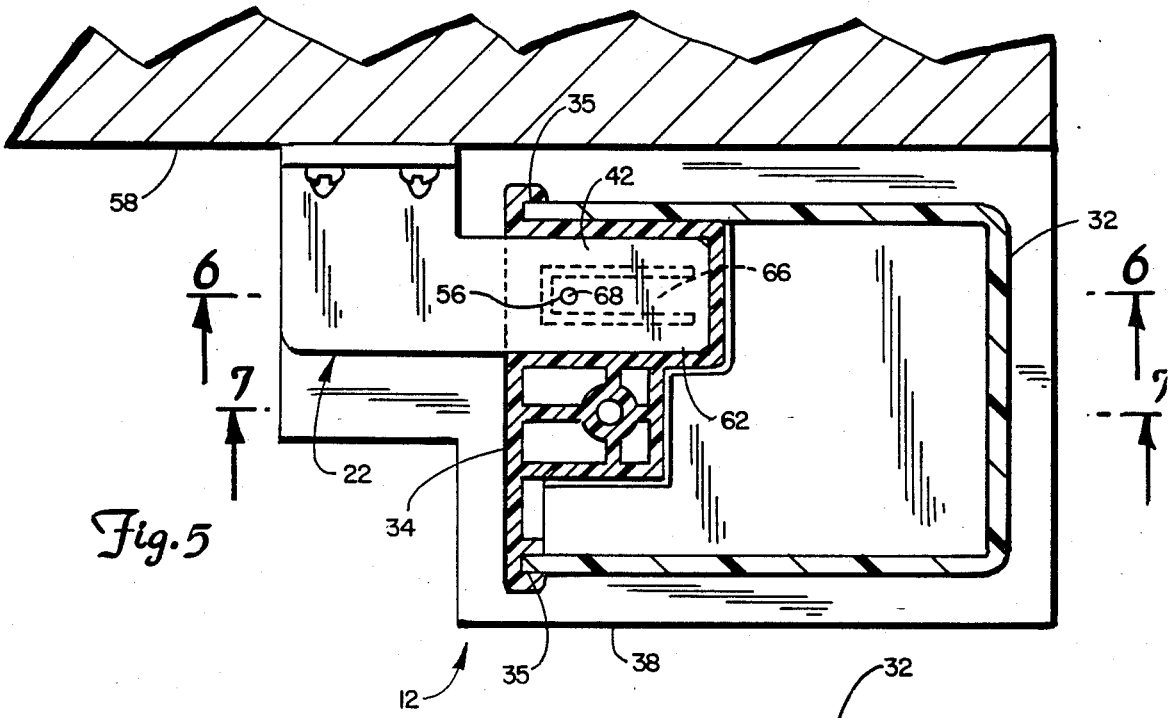
FIG. 5 is a sectional view illustrating the attachment of the bracket with the housing in the second rotational orientation.

FIG. 5 illustrates the second orientation of housing 12 with respect to mirror image brackets. Slot 62 is now mated with mounting arm 42 of bracket 22. Again, torsion member 66 and detent surface 68 cooperate with a bore 56, here in elongated arm 42, for fixing housing 12 to support bracket 42. In distinction to the first orientation, end piece 38 is now oriented with respect to supporting surface to bring an elongated edge of the end piece along the supporting surface. In the first orientation of housing 12, shown in FIG. 4, end piece 38 has a notched corner 40 supported around an edge 28.

Figure 6:
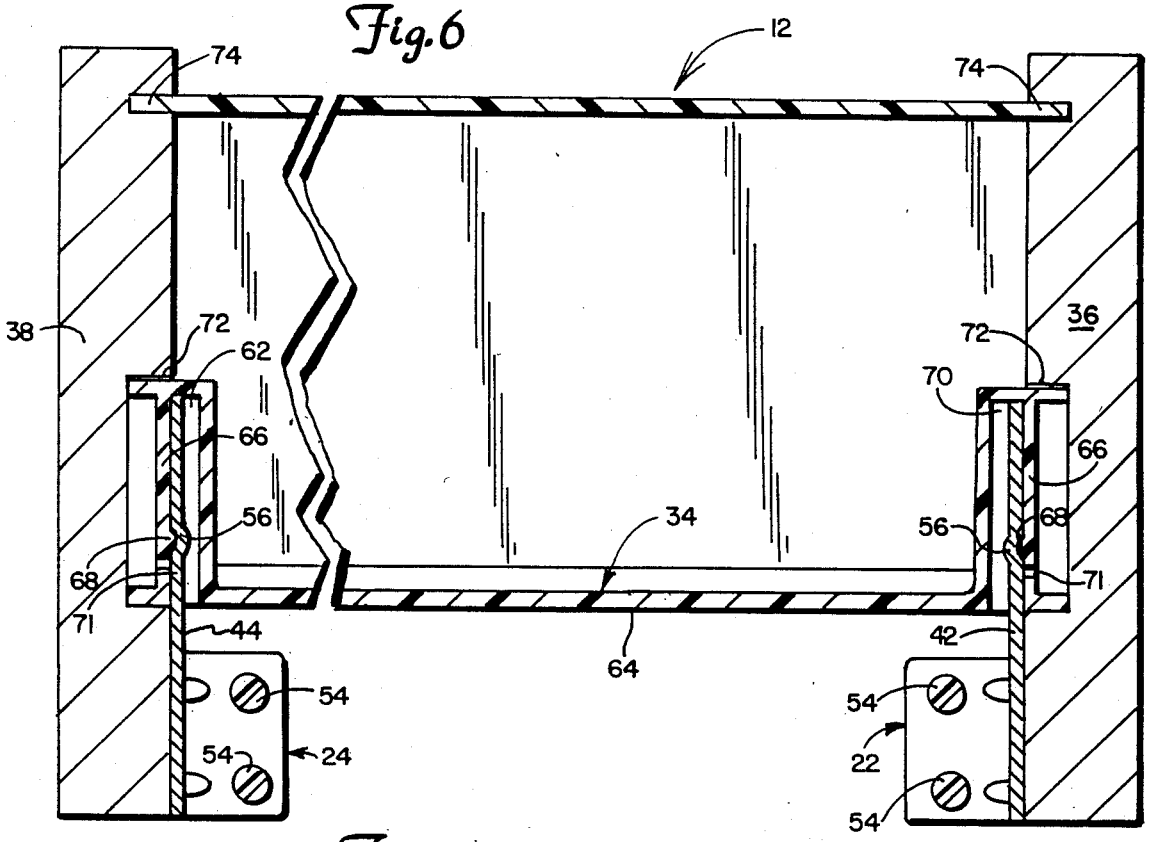
FIG. 6 is a cross-sectional view of the light fixture taken along the line 6—6 in FIG. 5.

FIG. 6 illustrates in cross section the mating of mounting arms 42 and 44 with slots 70 and 62, respectively, as occurs when housing 12 is positioned on mirror image brackets 22 and 24 in the second orientation. In the alternative orientation, housing 12 is rotated to bring slot 62 into engagement with mounting arm 42 of bracket 22 and slot 70 into engagement with mounting arm 44 of bracket 24. The relatively outside interior walls 71 are in contact with mounting arms 42 and 44 along one face thereof each. Interior walls 71 include torsion members 66 with detent surfaces 68. Detent surfaces 68 are positioned to engage bores 56 in mounting arms 42 and 44 when the arms are substantially fully introduced to slots 62 and 70.

Figure 7:
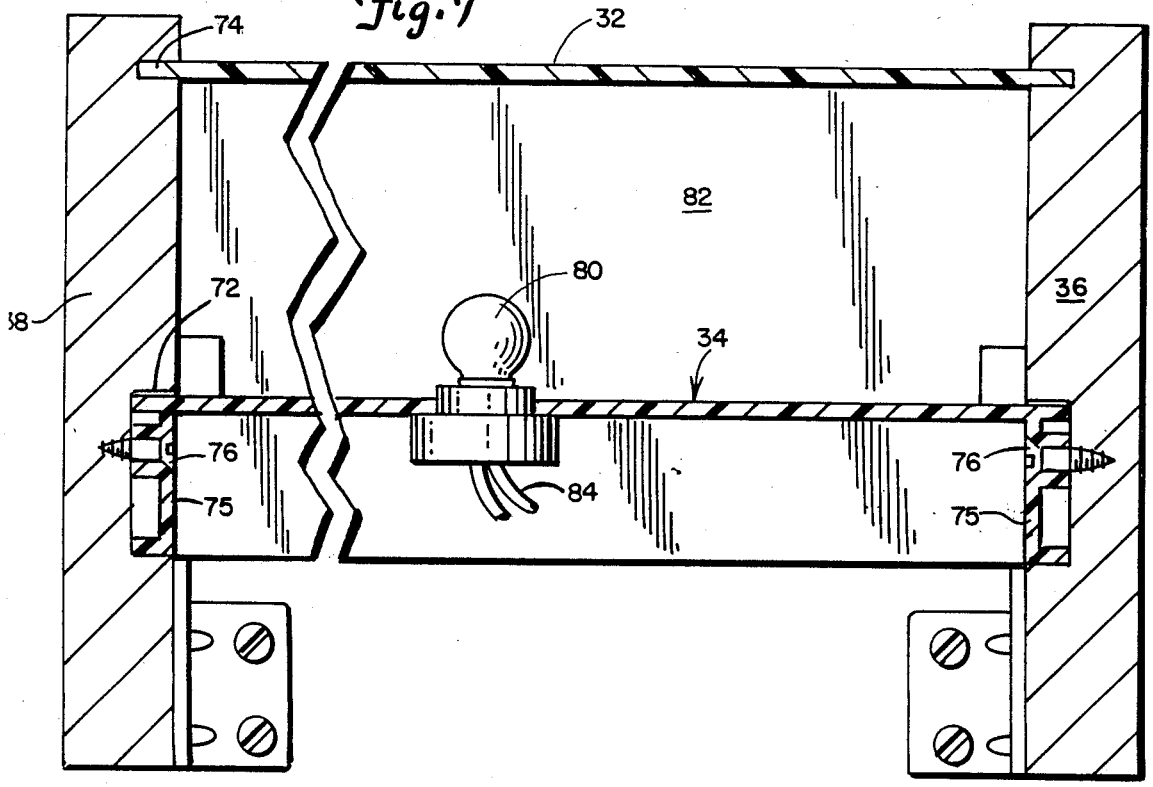
FIG. 7 is a cross-sectional view taken along the line 7—7 in FIG. 5.

As illustrated in FIGS. 6 and 7, end pieces 36 and 38 have channels 72 and 74 in opposing faces for receiving and supporting translucent body 32 and backplane 34, respectively, along the opposite longitudinal ends of the translucent body and backplane. Fasteners 76 are screwed through flanges 75 of backplane 34 to secure the backplane, and translucent body 32, between end pieces 36 and 38. A low voltage light source 80 is positioned on backplane 34 in a weather tight cavity 82. Because light source 80 uses relatively little power, ventilation of cavity 82 is not required for cooling. Wires 84 connect a light source 80 to a power source.

Appropriate arrangement of light fixtures 10 provides a lighting system compatible stylistically with contemporary outdoor decks and porches. Use of light fixtures 10 allows dispensing with expensive, customized fixtures while preserving a customized, integrated feel of the lighting system with the architecture. The light fixtures, being usable in two orientations provide a lighting system of great adaptability to common outside decks.

Although the present invention has been described with reference to preferred embodiments, workers skilled in the art will recognize that changes may be made in form and detail without departing from the spirit and scope of the invention.

What is claimed is:

1. A lamp fixture comprising:
an illumination source;
a translucent, elongated housing;
a backplane to the elongated housing for supporting the illumination source within the housing;
first and second opaque endpieces for closing the opposite ends of the housing, each endpiece have a back edge substantially parallel to the backplane, each back edge having a right angled indentation at one corner thereof for flush mating of the end piece around an edge of a deck, wall, rail, riser, or similar portion of an outdoor structure; and
means for mounting the lamp fixture substantially flush with respect to the edge of a deck, wall or similar portion of an outdoor structure.

2. A light fixture including:
a rectangular backplane having first and second spaced apart mating slots;
a pair of mirror image mounting brackets for attachment to a support surface, each mounting bracket having an elongated support arm for interchangeably joining with either mating slot of the backplane, permitting mounting of the backplane on the mounting brackets in either of two rotational orientations; and
first and second endpieces positioned along a pair of opposite edges of the backplane and having shapes such that in one rotational orientation of the backplane with respect to the mounting brackets the endpieces appear flush with the support surface and in the second rotational orientation of the backplane the endpieces appear flush around an edge formed between the support surface and a second, intersecting surface.

3. The light fixture of claim 2 and further comprising:
a lamp mounted on the backplane; and
a translucent housing positioned between the endpieces and over the backplane for forming a substantially weathertight enclosure surrounding the lamp.

4. A lamp fixture adapted for attachment to a support surface, the lamp fixture comprising:
a pair of mirror image brackets adapted to be attached to the support surface in an opposed, spaced-apart relationship, each of the mirror image brackets having substantially identical elongated arm portions and mounting surface portions for abutting the support surface, the mounting surface portions being perpendicular to the elongated to the elongated arm portions;

a rectangular backplane with spaced slot means for receiving the elongated arm portions for mounting the backplane on the spaced mirror image brackets in one of two rotational orientations, the spaced slot means being aligned substantially parallel with and removed toward one edge of the backplane;

the spatial positioning of the light fixture relative to the support surface being determined by the rotational orientation of the backplane with respect to the mirror image brackets when mated therewith; and first and second endpieces positioned along a pair of opposite edges of the backplane and having shapes such that in one rotational orientation of the backplane with respect to the mounting brackets the endpieces appear flush with the support surface and in the second rotational orientation of the backplane the endpieces appear flush around an edge formed between the support surface and a second, intersecting surface.

5. The support system of claim 4 wherein the mating receptacles include detent means for detachably locking an elongated arm mated therewith, the detent means including spring means for urging the detent means against a mated elongated arm.

6. The support system of claim 5 wherein the elongated arms are adapted to cooperate with the detent means notwithstanding the rotational orientation of the backplane.

7. The support system of claim 4 wherein the lamp fixture includes a three-sided, elongated light emitting surface mounted to the backplane and a lamp support on the backplane between the backplane and the light transmitting surface.

8. The support system of claim 7 wherein opposite ends of the elongated light transmitting surface are enclosed by opaque end pieces.

9. The support system of claim 8 wherein the end pieces have a back edge substantially parallel with the backplane, each back edge having a right angled indentation at one corner thereof for flush mating of the end pieces around an edge of the flat surface defining an intersection between the flat surface and another surface.

* * * * *